US010371401B2

(12) United States Patent
Beaulieu et al.

(10) Patent No.: US 10,371,401 B2
(45) Date of Patent: Aug. 6, 2019

(54) CREATING DOMAIN VISUALIZATIONS

(71) Applicant: Honeywell International Inc., Morristown, NJ (US)

(72) Inventors: Conrad B. Beaulieu, Duluth, MN (US); Henry Chen, Beijing (CN)

(73) Assignee: Honeywell International Inc., Morris Plains, NJ (US)

( * ) Notice: Subject to any disclaimer, the term of this patent is extended or adjusted under 35 U.S.C. 154(b) by 279 days.

(21) Appl. No.: 14/821,012

(22) Filed: Aug. 7, 2015

(65) Prior Publication Data

US 2017/0038945 A1 Feb. 9, 2017

(51) Int. Cl.

| | |
|---|---|
| ***G06F 3/048*** | (2013.01) |
| ***G06F 3/00*** | (2006.01) |
| ***F24F 11/30*** | (2018.01) |
| *F24F 11/52* | (2018.01) |

(52) U.S. Cl.
CPC ..... *F24F 11/30* (2018.01); *F24F 11/52* (2018.01)

(58) Field of Classification Search
CPC ..... G06F 8/34; G06F 3/0481; G05B 19/0426
See application file for complete search history.

(56) References Cited

U.S. PATENT DOCUMENTS

| | | | | |
|---|---|---|---|---|
| 8,689,120 | B2 * | 4/2014 | McGreevy | G05B 19/409 715/762 |
| 9,170,574 | B2 * | 10/2015 | Fuller | G05B 15/02 |
| 2007/0132767 | A1 * | 6/2007 | Wright | G06K 9/00771 345/475 |
| 2012/0039503 | A1 * | 2/2012 | Chen | G06T 19/00 382/100 |
| 2014/0067133 | A1 * | 3/2014 | Liu | G06F 17/5004 700/276 |
| 2014/0078151 | A1 * | 3/2014 | Garr | G06T 11/206 345/440.2 |
| 2015/0109332 | A1 * | 4/2015 | Manzoni | G06F 3/04842 345/629 |

* cited by examiner

*Primary Examiner* — Mahelet Shiberou
(74) *Attorney, Agent, or Firm* — Seager, Tufte & Wickhem LLP

(57) ABSTRACT

Methods, devices, and systems for creating a domain visualization are described herein. One method includes receiving a selection of a particular visualization template from a plurality of visualization templates, receiving instance information associated with a domain specified by the template from an instance source, receiving operating information from at least one instance of the domain, and displaying a visualization of the domain using the template, the instance information, and the operating information.

18 Claims, 5 Drawing Sheets

CREATING DOMAIN VISUALIZATIONS

TECHNICAL FIELD

The present disclosure relates to methods, devices, and systems for creating domain visualizations.

BACKGROUND

At a facility, users may use one or more visualizations to install, maintain, and/or monitor facility systems and/or devices. Visualizations can include diagrams such as line, branching, Sankey, and/or flow diagrams, for instance, among other types of visualizations. The appearance and/or layout of a visualization may be governed by the domain to which it pertains. Users operating in the heating, ventilation, and air conditioning (HVAC) domain may desire one type of visualization, while users in an energy plant domain may desire another, different type of visualization. In some instances, the appearance and/or layout of a visualization for a particular domain may be standardized through tradition, custom, and/or formal adoption by a governing body.

In previous approaches, a visualization may be created individually by a user having knowledge of its domain. That is, one or more users may create and/or modify a visualization using a computerized drawing tool (e.g., diagramming software). Such approaches may be time-consuming, especially so in cases where the desired visualization is complex. In addition, previous approaches become obsolete in the face of change(s) such as when, for example, a device is installed or removed from the facility.

DETAILED DESCRIPTION

Figure 1:
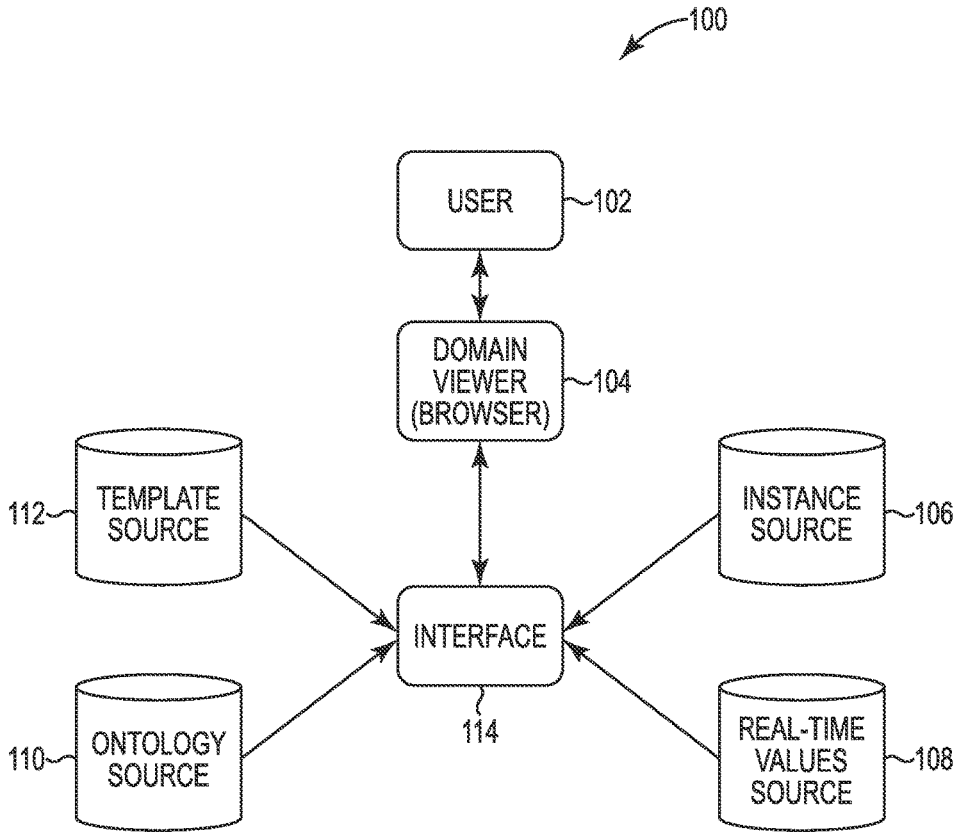
FIG. 1 illustrates a system for creating domain visualizations in accordance with one or more embodiments of the present disclosure.

Devices, methods, and systems for creating domain visualizations are described herein. For example, one or more embodiments include receiving a selection of a particular visualization template from a plurality of visualization templates, receiving instance information associated with a domain specified by the template from an instance source, receiving operating information from at least one instance of the domain, and displaying a visualization of the domain using the template, the instance information, and the operating information.

Domain visualizations in accordance with one or more embodiments of the present disclosure can be created (e.g., created, edited, modified, etc.) using an interface that allows the display and/or editing of domain visualizations. Domain visualizations can be created with much less user input than previous approaches. The increased automation afforded by embodiments of the present disclosure can yield savings in time and monetary cost. In addition, embodiments of the present disclosure can create visualizations that depict more than one domain (it is noted that a "domain visualization" as used herein can refer to a visualization of a single domain and/or a visualization of more than one domain). Such visualizations can drive decision making at higher levels than previous approaches.

Further, visualizations in accordance with the present disclosure can be updated (e.g., in real time) to reflect current conditions in a facility or to mirror changes in the device(s) and/or system(s) represented in the visualization. For example, in some embodiments, real-time values for temperature set points can be included in an HVAC domain visualization. In another example, the addition of a variable air volume (VAV) device to an HVAC system represented by a visualization can be represented in the visualization without a user needing to redraw the visualization (as in previous approaches).

Users operating in a particular domain (e.g., an HVAC domain) may desire one type of visualization (e.g., a line drawing having left-to-right branching and circular flow), while users in an energy plant domain may desire another type of visualization (e.g., an operational view featuring real-time state(s) and/or value(s) associated with machines). A known and/or standardized manner of communicating information associated with a particular domain can be defined by an ontology associated with the domain. The ontology of a particular domain may be standardized through tradition, custom, and/or formal adoption by a governing body, for instance.

An "ontology," as referred to herein, can be a naming, description, and/or definition of the types, properties, and/or interrelationships of the instances of a domain. An instance of a domain (herein referred to as "domain instance" or "instance") is a component (e.g., subset) of a domain. For example, domain instances can include devices, machines, connections, parameters, entities, and/or combinations of domain components. In an example, instances in the HVAC domain can include dampers, chillers, cooling towers, pumps, valves, air handling units (AHUs), fans, etc. In some embodiments, each domain may be associated with a respective ontology. In some embodiments, each domain may be associated with aspects of other, additional ontologies.

Visualizations in accordance with the present disclosure can be created using one or more domain visualization templates (hereinafter "visualization templates" or "templates"). A template can include instructions executable to dictate the manner in which a domain is to be visualized (e.g., displayed, shown, depicted, etc.) in accordance with the domain's ontology. In the HVAC example, a template for the HVAC domain can dictate that circular flow through an HVAC system is to be visualized by air out on the bottom of the visualization and return air on the top of the visualization.

A user can select a particular template based on one or more desired domains of a facility to be visualized. Information associated with the facility can be received and used to enrich (e.g., customize) the template. In some embodiments, the information can be received from a database (e.g., an instance database), and may be stored in connection with configuration of devices in the facility. In some embodiments, the information can be real-time information received from facility devices themselves and/or a computing device (e.g., computing devices and/or controllers) associated with facility devices.

The template can be enriched with the information such that the user is provided with a visualization of the desired domain (or domains). As discussed further below, an interface can be provided that allows the user to modify aspects of the visualization, such as display elements, for instance.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that process changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits.

FIG. 1 illustrates a system 100 for creating domain visualizations in accordance with one or more embodiments of the present disclosure. As shown in FIG. 1, a user 102 can access a domain instance management editor 110 via a domain viewer 104. The domain viewer 104 can be a browser and/or application executed by a computing device, for instance. The domain instance management editor 114 can be an interface (e.g., display) that provides functionalities to facilitate the creation and/or modification of one or more domain visualizations and is hereinafter referred to as "interface 114".

The interface 114, which is further discussed below in connection with FIG. 2, can communicate with and/or receive information from various sources. As shown, the interface 114 can receive information from an instance source 106, a real-time values source 108, a template source 112, and/or an ontology source 110. The instance source 106, the real-time values source 108, the template source 112, and the ontology source 110 may be cumulatively referred to herein as "information sources 106-112."

One or more of the information sources 106-112 can be a database and/or an application program interface (API), for instance, though embodiments of the present disclosure are not so limited. In some embodiments, one or more of the information sources can be a facility device (e.g., a VAV device). In some embodiments, one or more of the sources can be a computing device and/or a controller associated with a facility device. Further, though four information sources 106-112 are illustrated in FIG. 1, embodiments of the present disclosure can include more or fewer information sources 106-112.

The ontology source 110 can include one or more ontologies that define how to describe one or more domains. As previously discussed, an ontology can be a naming, description, and/or definition of the types, properties, and/or interrelationships of the valid instances of a domain. A validation can be performed to determine if instances are valid, for instance, against one or more composition rules in a template (discussed below). In short, the interface 114 can receive information from the ontology source 114 regarding the rules of how a particular domain (or domains) is to be shown in a visualization of that domain.

The template source 112 can store and/or provide templates used to create visualizations. The template source 112 can include a plurality of templates. In some embodiments, each of the plurality of templates can be associated with a particular domain. In some embodiments, a template can be associated with a plurality of domains. A template can dictate how a domain is to be visualized in accordance with the ontology of the domain. A template can be considered to be an encoding of the visualization rules defined by an ontology.

A template can include a plurality of symbols (e.g., a symbol library) that are relevant to a particular domain. For example, a template associated with an HVAC domain may contain standardized symbols that represent common devices in an HVAC system (e.g., fans, ducts, etc.), whereas a template associated with an electrical wiring domain may contain standardized symbols that represent common devices in an electrical system (e.g., resistors, voltage sources, transformers, etc.).

As discussed below, the user 102 can select a particular template from the plurality of templates. Embodiments of the present disclosure are not limited to a particular manner of making such a selection. For example, the template can be selected form a displayed list of templates. The selection can be based on the domain of which visualization is desired. The selected template can be displayed using the interface 114.

The instance source 106 can contain information associated with domain instances, which may be referred to as "instance information." As previously discussed, domain instances are components of a domain. For example, domain instances can include devices, machines, connections, parameters, entities, and/or combinations of domain components. In an example, domain instances in the HVAC domain can include dampers, chillers, cooling towers, pumps, wiring, piping, sensors, actuators, valves, air handling units (AHUs), fans, etc. Instance information can include configuration information. Instance information can include information describing a particular device, how the device operates, how the device is connected to other devices, how the device interacts with other devices, configuration information associated with the device, a functional profile of the device, settings (e.g., communications settings) of the device, device interface definitions or reference, version number(s) of the device, device timing, etc.

The real-time values source 108 can contain information associated with the actual operation of specific domain instances. In some embodiments, the real-time values source 108 can be (or include) a facility device capable of communicating its operating information to the interface 114. In some embodiments, the real-time values source 108 can be (or include) a controller and/or computing device associated with (e.g., controlling operation of) a facility device capable of communicating operating information of the facility device to the interface 114.

Operating information, as referred to herein, includes real-time information describing one or more aspects of the operation of a facility device. Information that constitutes operating information may depend on the particular type of facility device. For example operating information can include temperature, speed (e.g., fan speed), status (e.g., on, off, open, closed, etc.), set point, condition (e.g., normal, abnormal, etc.), pressure, voltage, and/or flow rate, among others.

Figure 2:
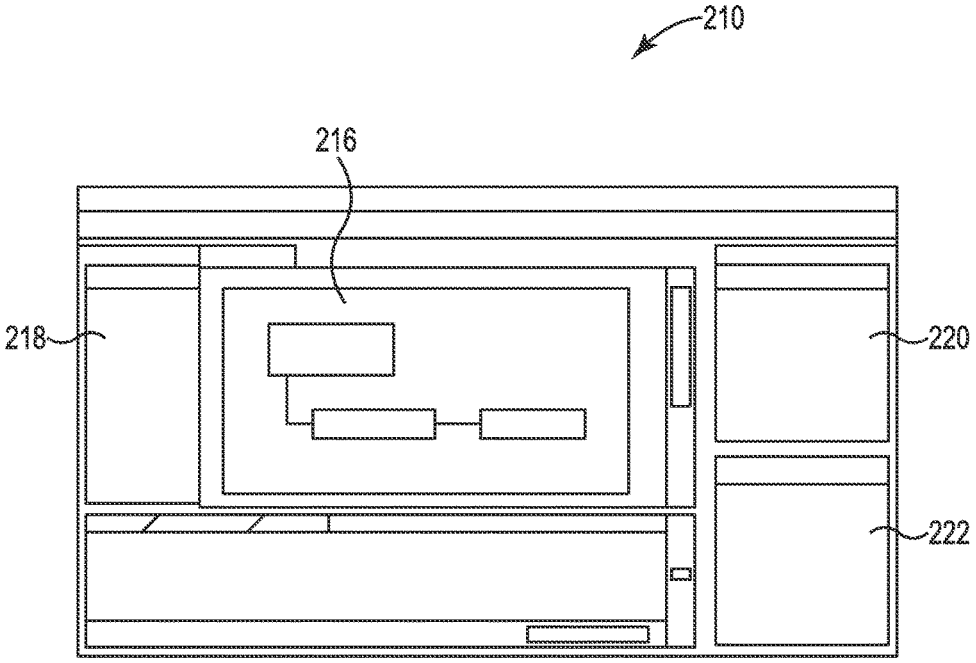
FIG. 2 illustrates an interface for creating a domain visualization in accordance with one or more embodiments of the present disclosure.

FIG. 2 illustrates an interface 210 for creating a domain visualization in accordance with one or more embodiments of the present disclosure. The interface 210 can provide the user with a way of viewing a domain visualization and/or modifying a domain visualization. As shown, the interface 210 includes a plurality of portions (e.g., windows). The interface 210 includes a visualization portion 216, a display element selection portion 218, a properties portion 220, and a display element modification portion 222. Though four portions are illustrated in FIG. 2, the interface 210 can include more or fewer portions.

The interface 210 can allow the selection of a particular visualization template from a plurality of visualization templates. In some embodiments, the selection can be made by a user. In some embodiments the selection can be made without user input. For example, the template can be determined based on information received from one or more sources indicating a particular domain for visualization. The interface 210 can receive information from one or more sources. For instance, the interface 210 can receive information from the instance source 106, the real-time values source 108, the template source 112, and/or the ontology source 110.

When the template is selected, a domain specified by the template can be extracted from the received information. The interface 210 can constrain the expressivity of the visualization to valid concepts, relationships, and/or properties as defined in the corresponding ontology (or ontologies). In some embodiments, more than one domain can be extracted. Along with the domain, semantic information referenced in the information can be extracted. For example, the domain and referenced semantic information (e.g., "instance information") can be extracted from the instance source 106 and/or the real-time values source 108. Operating information can be received from specific instances of the domain associated with the selected template. As previously discussed, the operating information can be received from the real-time values source 108.

Once received, the information can be integrated into the template automatically (e.g., without user input) and a visualization can be created using the template and the information. The visualization can be displayed using the visualization portion 216. The visualization portion 216 can display the visualization as a model, for instance, which may include the selected template enriched with the received information from the instance source 106 and/or the real-time data source 108. The visualization portion 216 can allow the user to view the visualization. The visualization portion 216 can allow the user to see the effect(s) that modifications made to the visualization (e.g., using the other portion(s) of the interface 210) are having as those modifications are made (e.g., in real time).

The display element selection portion (DES) 218 can provide a plurality of selectable display elements used to modify the visualization (e.g., instance information of the visualization). For example, the DESP 218 can be a "toolbox" providing a plurality of display elements, such as selectable domain classes and/or shape types (e.g., representing facility devices) for addition to the visualization. In some embodiments, the DESP 218 can include selectable relationships between shapes, connectors, and/or shape maps. As used herein, a shape map refers to a wire-framed boundary which limits the type(s) of entities that can be contained or "dropped" therein. A shape map can organize the relative relationships of instance types to one another.

Though embodiments of the present disclosure are not so limited, the user can select a desired display element of DESP 218 and can then select a desired location of that element in the visualization portion 216 (e.g., a particular "target" region) for it to be placed. In some embodiments, the template can include placement rules, relative placement indicators, and/or element priority. For example, a target region may accept only certain element types. In another example, one or more rules can be enforced causing elements to be moved appropriately with respect to other elements, while still permitting user relocation of elements within a region determined automatically.

The properties portion 220 can allow the user to modify non-displayed elements of the visualization. In some embodiments, the properties portion 220 can allow the addition of toolbox items to the visualization. In some embodiments, the properties portion 220 can allow the activation of a validation process associated with the visualization.

The display element modification portion (DEMP) 222 can allow the user to modify the display elements of the visualization (including display elements added to the visualization using the DESP 218). In some embodiments, the DEMP 222 can display properties of the display elements of the visualization. The properties can be modified such that the user can control how display elements are displayed, how display elements can be copied, and/or how display elements can be deleted. The DEMP 222 can allow the user to modify how the display elements of the visualization are displayed (e.g., size, color, modality, relative placement indication, priority, etc.).

In some embodiments, the display of the display elements (e.g., the operating information displayed using the display elements) can be user-defined. That is, a user-defined preference can be used to display the operating information. For example, a desired level of detail and/or a desired level of information context associated with the displayed operating information can be user-defined.

In some embodiments, the user-defined preference(s) can be determined based on a profile of the user, for instance. In some embodiments, the user-defined preference(s) can be determined based on a task identified by the user. In some embodiments, the user-defined preference(s) can be determined based on a workflow. A workflow, as referred to herein, describes a series of operations that must be performed in a certain order and verified to successfully complete a specified task. A workflow definition is a formal language that defines a workflow so it can be repeated with automatic and possible manual steps intermixed. A workflow language includes action steps, timing, data validation, and/or error processing. Using an ontology to model a workflow language and its interplay with service or automation interfaces, including human interface communications and response interpretation, allows the definition of full operational instance definitions in one place.

Thus, utilizing the DESP 218, the properties portion 220, and/or the DEM P 222, the user can modify various aspects of a visualization displayed by the visualization portion 216. The created (e.g., created and/or modified) visualization can be stored in memory, for instance.

Figure 3:
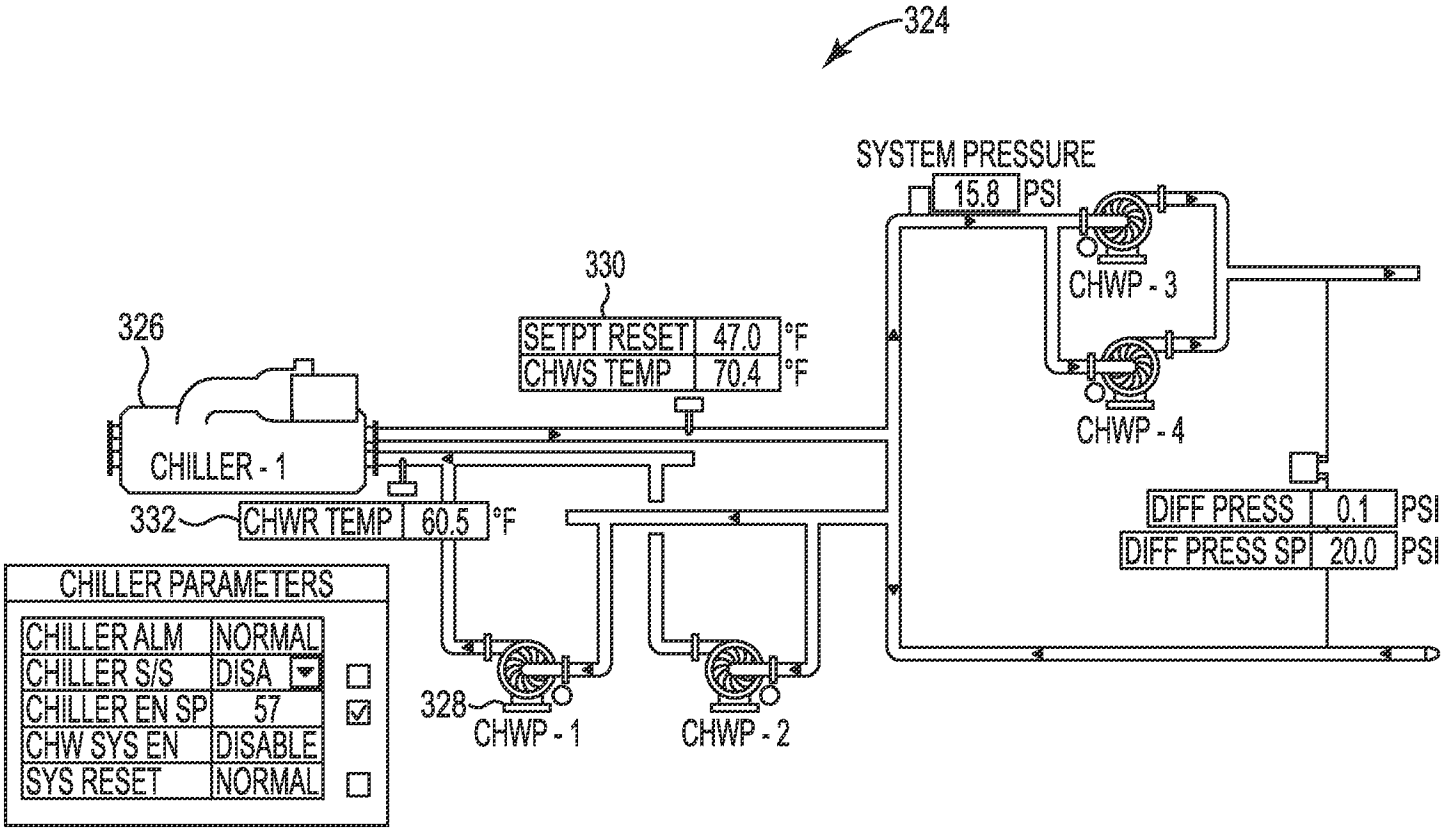
FIG. 3 illustrates an example domain visualization in accordance with one or more embodiments of the present disclosure.

FIG. 3 illustrates an example domain visualization 324 in accordance with one or more embodiments of the present disclosure. The visualization 324 illustrated in FIG. 3 can be a visualization associated with a portion of an HVAC domain, for instance. The visualization 324 can be created using the interface 210, previously discussed in connection with FIG. 2.

As shown in FIG. 3, the visualization 324 includes a plurality of display elements. For example, the visualization 324 includes a chiller 326 and a pump 328. As shown the visualization 324 includes a plurality of real-time values. For example, a box 330 includes "Setpt Reset" and "CHWS Temp" information indicating that setpoint reset is set to 47 degrees Fahrenheit and a water supply from the chiller 326 is 70.4 degrees Fahrenheit. Additionally, a box 332 includes "CHWR Temp" information indicating that the return water supply to the chiller 326 is 60.5 degrees Fahrenheit. The visualization 324 can be updated (e.g., automatically updated) as these values change. Additionally, the visualization 324 can be updated as the template and/or instance information is changed.

Figure 4:
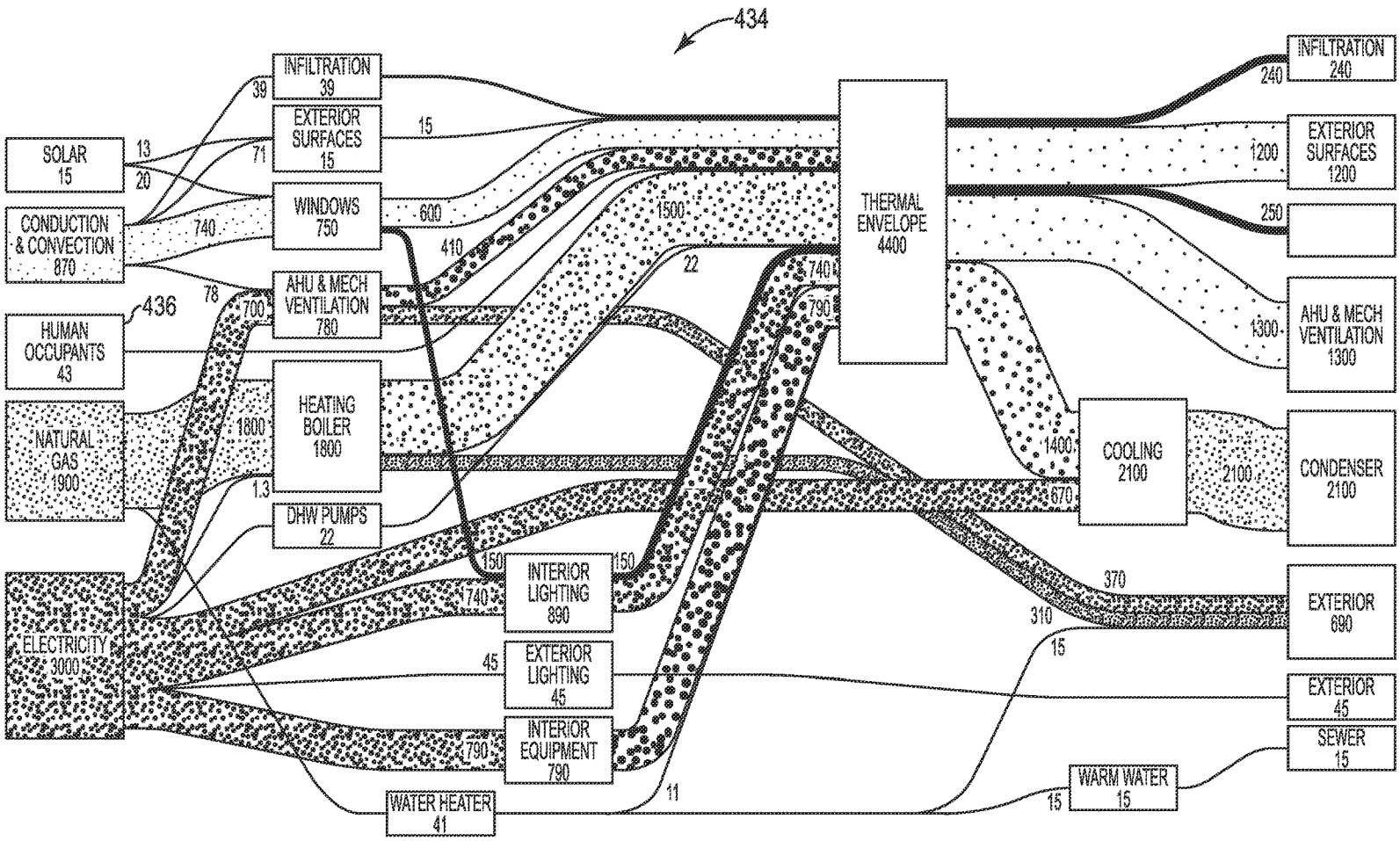
FIG. 4 illustrates another example domain visualization in accordance with one or more embodiments of the present disclosure.

FIG. 4 illustrates another example domain visualization 434 in accordance with one or more embodiments of the present disclosure. The domain visualization 434 is an example of a Sankey diagram. The visualization 434 provides an up-to-the-minute display of the energy usage in a facility, for instance. The visualization 434 is an example of a multi-domain visualization in accordance with the present disclosure. That is, the visualization 434 encompasses more than a single domain. To illustrate, a human occupants box 436 displays the number of human occupants in a facility. The human occupants box 436 may be supplied with this information from an access control domain, an occupancy tracking domain, a security domain, and/or a surveillance domain, among others.

Figure 5:
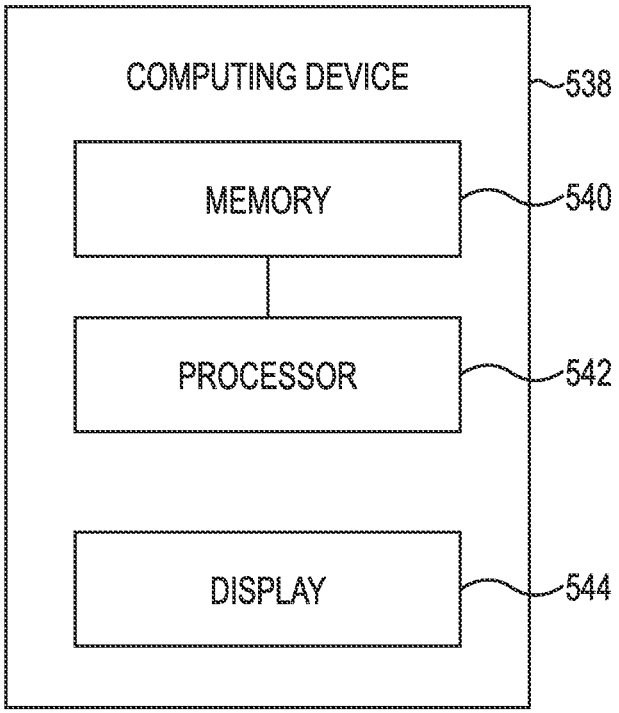
FIG. 5 illustrates a computing device for creating a domain visualization in accordance with one or more embodiments of the present disclosure.

FIG. 5 illustrates a computing device 538 for creating a domain visualization in accordance with one or more embodiments of the present disclosure. Computing device 538 can be, for example, a laptop computer, a desktop computer, or a mobile device (e.g., a mobile phone, a personal digital assistant, etc.), among other types of computing devices.

As shown in FIG. 5, computing device 538 includes a memory 540 and a processor 542 coupled to memory 540. Memory 540 can be any type of storage medium that can be accessed by processor 542 to perform various examples of the present disclosure. For example, memory 540 can be a non-transitory computer readable medium having computer readable instructions (e.g., computer program instructions) stored thereon that are executable by processor 542 to create a domain visualization in accordance with one or more embodiments of the present disclosure.

Memory 540 can be volatile or nonvolatile memory. Memory 540 can also be removable (e.g., portable) memory, or non-removable (e.g., internal) memory. For example, memory 540 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disc read-only memory (CD-ROM)), flash memory, a laser disc, a digital versatile disc (DVD) or other optical disk storage, and/or a magnetic medium such as magnetic cassettes, tapes, or disks, among other types of memory.

Further, although memory 540 is illustrated as being located in computing device 538, embodiments of the present disclosure are not so limited. For example, memory 540 can also be located internal to another computing resource (e.g., enabling computer readable instructions to be downloaded over the Internet or another wired or wireless connection).

As shown in FIG. 5, computing device 538 can also include a display 544. The display 544 can be analogous to the interface 114 and or the interface 210, previously discussed in connection with FIGS. 1 and 2, though embodiments of the present disclosure are not so limited. The display 544 can include a screen, for instance. The display 544 can be, for instance, a touch-screen (e.g., the display 544 can include touch-screen capabilities).

The display 544 can provide (e.g., display and/or present) information to a user of the computing device 538. For example, the display 544 can display the portions 104, 216, 218, 220, and/or 222 previously described in connection with FIGS. 1 and/or 2.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A non-transitory computer-readable medium having instructions stored thereon that are executable by a processor to:

store a plurality of facility domain visualization templates, wherein the plurality of facility domain visualization templates includes:

a heating, ventilation, and air conditioning (HVAC) domain visualization template having a first ontology and a first set of display elements associated with an HVAC domain;

an energy domain visualization template having a second ontology and a second set of display elements associated with an energy domain; and a domain visualization template having a third ontology and a third set of display elements associated with a plurality of facility domains;

provide an interface configured to allow a user to modify a domain visualization of an HVAC domain created from the HVAC domain visualization template, wherein the interface includes:

a first portion configured to display the visualization;

a second portion configured to provide the first set of display elements used to modify the visualization, each of the first set of display elements associated with a respective device type of an HVAC system of a facility;

a third portion configured to allow modification of non-displayed elements of the HVAC domain visualization; and a fourth portion configured to allow modification of selected ones of the first set of display elements of the visualization;

determine that operating information associated with the HVAC system and received from at least one device of the HVAC system corresponds to an HVAC domain instance of the visualization, the operating information comprising real-time information describing an operation of at least one facility device and including at least one of a measurement, setting, status, and condition of the at least one facility device; and create an HVAC domain visualization using the operating information, wherein the HVAC domain visualization includes the selected ones of the first set of display elements.

2. The medium of claim 1, wherein the first set of display elements includes a plurality of display icons associated with HVAC system devices.

3. The medium of claim 1, wherein the second portion is configured to allow modification of a display of a relationship between the first set of display elements.

4. The medium of claim 1, wherein the fourth portion is configured to allow modification of:

at least one property value for selected ones of the first set of display elements; and at least one property value for a relationship between selected ones of the first set of display elements.

5. A method for creating a domain visualization, comprising:

receiving a selection of a particular facility domain visualization template from a plurality of facility domain visualization templates, wherein the plurality of facility domain visualization templates includes a facility domain visualization template having a first set of display elements associated with a heating, ventilation, and air conditioning domain, a facility domain visualization template having a second set of display elements associated with an energy domain, and a facility domain visualization template having a third set of display elements associated with a plurality of facility domains;

receiving instance information associated with a domain specified by the particular facility domain visualization template from an instance source;

receiving operating information from at least one instance of the facility domain, the operating information comprising real-time information describing an operation of at least one instance of the facility domain and including at least one of a measurement, setting, status, and condition of the at least one instance of the facility domain; and displaying a visualization of the facility domain using the particular facility domain visualization template, the instance information, and the operating information.

6. The method of claim 5, wherein the plurality of facility domain visualization templates includes at least one template associated with each of:

a lighting domain;

an access control domain;

a water supply domain;

a security domain;

a visual security domain;

a facility management domain;

a people tracking domain;

a building maintenance domain;

a data analytics domain; and a building control domain.

7. The method of claim 5, wherein each of the plurality of facility domain visualization templates is associated with a different ontology.

8. The method of claim 5, wherein the particular facility domain visualization template is based on an ontology corresponding to the domain specified by the template.

9. The method of claim 5, wherein the visualization is a two-dimensional diagram.

10. The method of claim 5, wherein the diagram is one of:

a line diagram;

a branching diagram;

a circular flow diagram; and a Sankey diagram.

11. The method of claim 5, wherein displaying the visualization of the facility domain includes displaying the visualization in accordance with an ontology associated with the facility domain.

12. The method of claim 5, wherein receiving operating information from at least one instance of the facility domain includes receiving operating information from at least one device of a facility.

13. The method of claim 5, wherein the method includes allowing a user to control a level of detail of the displayed visualization.

14. The method of claim 5, wherein the method includes:

receiving additional operating information from the at least one instance of the facility domain after the visualization has been displayed; and updating the visualization using the additional received operating information.

15. A system for creating a domain visualization, comprising:

a plurality of heating, ventilation, and air conditioning (HVAC) system devices, the plurality of devices including a pump, a valve, an air handling unit, and a fan; and a computing device configured to receive operating information associated with the HVAC system devices, the operating information comprising real-time information describing an operation of the HVAC system devices and including at least one of a measurement, setting, status, and condition of each of the HVAC system devices, the computing device including:

a processor; and a memory configured to store instructions executable by the processor to:

determine that the operating information corresponds to an HVAC domain;

select an HVAC domain visualization template from a plurality of facility domain visualization templates based on the determined HVAC domain, wherein the plurality of facility domain visualization templates includes the HVAC domain visualization template having a first set of display elements, an energy domain visualization template having a second set of display elements, and a facility visualization template having a third set of display elements associated with a plurality of facility domains; and display the operating information using the first set of display elements according to the HVAC domain visualization template and at least one user-defined preference.

16. The system of claim 15, wherein the at least one user-defined preference is determined based on at least one of:

a profile of a user;

a workflow; and a task identified by the user.

17. The system of claim 15, wherein the at least one user-defined preference includes a desired level of detail and a desired level of information context associated with the displayed operating information.

18. The system of claim 15, wherein the HVAC domain visualization template defines:

a particular display element of the first set of display elements associated with each of the HVAC system devices;

at least one manner of displaying a connection between at least two of the plurality of HVAC system devices; and a relative orientation of the first set of display elements.

* * * * *